United States Patent [19]

Hanula

[11] Patent Number: 4,637,518

[45] Date of Patent: Jan. 20, 1987

[54] COUPLER FOR A RAILWAY CAR COUPLER ASSEMBLY

[75] Inventor: Richard M. Hanula, Lyndhurst, Ohio

[73] Assignee: Seher Acquisition Corp., Oakbrook Terrace, Ill.

[21] Appl. No.: 720,798

[22] Filed: Apr. 8, 1985

[51] Int. Cl.[4] ..... B61G 9/20

[52] U.S. Cl. ..... 213/64; 213/62 A; 213/69

[58] Field of Search ..... 213/62 R, 62 A, 64, 213/67 R, 67 A, 69

[56] References Cited

U.S. PATENT DOCUMENTS

| | | | |
|---|---|---|---|
| 3,709,376 | 1/1973 | Altherr | 213/62 R |
| 4,350,256 | 9/1982 | Hanula et al. | 213/69 |
| 4,428,489 | 1/1984 | Hanula | 213/62 A |

FOREIGN PATENT DOCUMENTS

| | | | |
|---|---|---|---|
| 1605195 | 4/1980 | Fed. Rep. of Germany | 213/62 R |
| 763817 | 12/1956 | United Kingdom | 213/62 A |

*Primary Examiner*—Randolph A. Reese

[57] ABSTRACT

A coupler for a railway car coupling system includes an elongated shank terminating in a generally rectangular butt portion. The shank is generally octagonal in cross-section for strength, and the coupler butt portion has an end face provided with a convex spherically radiused contact area. The contact area is adapted to cooperate with a follower having a correspondingly concave spherically apertured recess. The butt portion end face is also provided with relieved corners to reduce wear and scoring thereon as it contacts and rotates against the follower. Relieved portions are provided in the coupler butt portion adjacent a transverse pin receiving aperture for accommodating limited angling of the coupler within the coupling system.

5 Claims, 5 Drawing Figures

COUPLER FOR A RAILWAY CAR COUPLER ASSEMBLY

BACKGROUND OF THE INVENTION

This invention relates generally to coupler assemblies for railway cars and the like, and, more specifically, to an improved coupler for such a coupler assembly. Although the invention will be described with particular reference to a coupler for an F-type rotary coupler assembly, it will be appreciated that certain features thereof may also be used or adapted to use in other coupler assembly applications.

After the introduction of the rotary coupler assembly, a train comprised of loaded railways cars of the open top or hopper-type (which may contain coil, ore etc.) could be emptied without having to uncouple and separate the cars. This was accomplished by rotating each car up to 180° about its longitudinal centerline while the car remained connected on both ends to adjacent cars. This capability speeded up the gravity unloading process. Rotary coupling systems typically include a yoke assembly and a coupler, along with a follower, a draft gear, and a striker. In addition, the yoke assembly may include a cylindrical connector, a connecting pin, and pin support apparatus.

Couplers of the known type include a coupler head, an elongated shank, and a butt portion terminating in a free end. The coupler shanks in prior non-rotary railway coupler assemblies have been of a large, generally square cross-section, whereas coupler shanks in prior rotary coupler assemblies have generally been circular and of smaller cross-section than the shanks of non-rotary types. The tremendous growth in size of railroad cars over the past decade has, however, placed severe strains on the conventional couplers used in those coupling systems presently available.

Moreover, disrepair of railroad beds has caused misalignment of trackways which produces undesirable movement between adjacent railroad cars. Such movement, along with wear caused by rapid mileage accumulations, creates heretofore unknown fatigue failures in the components of conventional car coupling assemblies. One of the components which fails is the coupler. Thus, it has been considered desirable to provide a coupler which is stronger and more durable even under the most severe service conditions.

In order to enhance the strength of one type of coupler assembly, the components thereof have been redesigned. Such redesign is disclosed in the commonly assigned U.S. patent applications to Richard M. Hanula, Ser. No. 322,217, now U.S. Pat. No. 4,428,489, entitled AN IMPROVED ROTARY RAILROAD CAR COUPLER, and Ser. No. 518,822 filed 8-1-83, now abandoned, entitled STRIKER FOR RAILWAY CARS, the teachings of which are incorporated hereinto by reference.

Another coupler assembly component which has been improved is the yoke. Such improvement is disclosed in the commonly assigned U.S. patent application to Richard M. Hanula which is being filed concurrently herewith, entitled IMPROVED YOKE FOR RAILWAY CAR COUPLER ASSEMBLY, Ser. No. 720,690, filed on Apr. 8, 1985, the teachings of which are also incorporated hereinto by reference. The improved yoke disclosed therein has been redesigned to better withstand stresses. To accommodate such redesign, it has also been necessary to enlarge the yoke aperture to properly accept the reinforced coupler shank of the present invention.

With regard to conventional F-type coupler shanks, it has been found that heavy wear and scoring occurs on the coupler butt end due to the presence of concentrated loads on the corner areas, and too little initial load bearing area between conventional contact faces of the coupler and follower. This result is caused by the fact that a convex contact face on the coupler butt portion is likely to have a larger radius through tolerance variations that a concave contact face on an associated follower. This, in turn, means that the coupler butt portion will rest on its corners due to its generally rectangular shape.

The reason for providing both the butt portion and follower contact faces with substantially the same radius is to provide the center of the coupler butt portion with some relief for avoiding adverse loading at that area. Such loading would quickly lead to a fracture of the coupler butt portion at its center. Since this type of relief brings about the above noted difficulty with contact at the outer four corners of the coupler butt portion, it would be desirable to provide means for insuring better initial contact between the spherical contact faces of the coupler and follower.

The present invention contemplates a new and improved railway car coupler which overcomes the foregoing difficulties and others, and which provides better and more advantageous overall results.

BRIEF SUMMARY OF THE INVENTION

A rotary coupler assembly of the type described includes an improved coupler which can better withstand the increased stresses of modern use.

According to the invention, the improved coupler has a coupler body including a generally rectangular butt portion and a narrower shank portion extending outwardly from the butt portion. The butt portion is provided at its free end with a spherical end face for cooperation with a follower which has a corresponding spherical recess. The butt portion free end is also provided with relieved corners to reduce wear and scoring as it contacts and rotates against the follower.

In accordance with another aspect of the invention, relieved portions are provided adjacent a transverse pin receiving aperture in the butt portion for allowing limited angling of the overall coupler within the coupler assembly.

In accordance with still another aspect of the invention, the coupler shank has a generally octagonal cross-section for increasing coupler strength at that area.

The principal focus of the present invention is the provision of an improved rotary coupler assembly.

One advantage of the invention is the provision of a particular spherically radiused face and relieved corners on the free end of the coupler butt portion for reducing wear and scoring on the free end.

Another advantage of the invention is the provision of relieved portions adjacent a pin receiving aperture in the coupler butt portion to facilitate limited angling movement of the coupler within an overall coupling assembly.

Still another advantage of the invention is the provision of an improved coupler which has a new configuration for the shank to provide added strength.

Further advantages of the invention will become apparent to those skilled in the art upon a reading and understanding of the following detailed description.

BRIEF DESCRIPTION OF THE DRAWINGS

The invention may take form in certain parts and arrangements of parts, a preferred embodiment of which will be described in detail in this specification and wherein.

DETAILED DESCRIPTION OF THE PREFERRED EMBODIMENT

Figure 1:
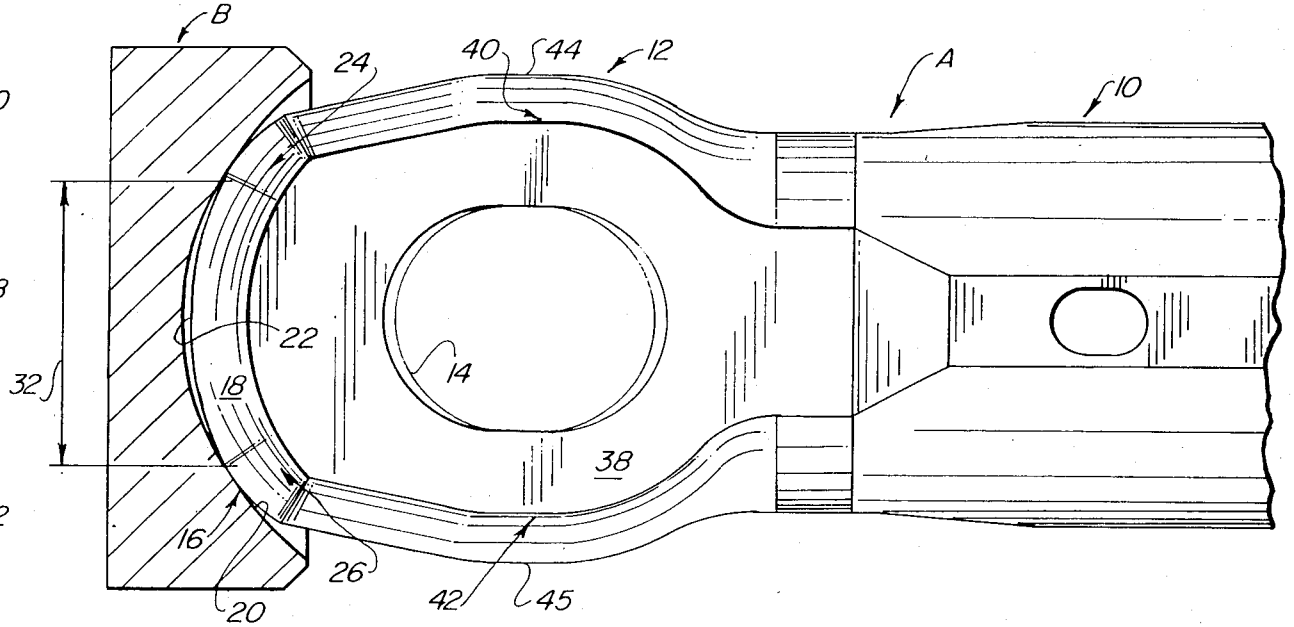
FIG. 1 is a plan view of a coupler formed in accordance with the present invention contacting a follower which is shown in cross-section for clarity.

With reference to the drawings, wherein the showings are for purposes of illustrating a preferred embodiment of the invention only and not for purposes of limiting same, FIG. 1 shows a coupler A formed in accordance with the present invention. The coupler includes a conventional head or knuckle portion (not illustrated), a shank portion 10, and a butt portion 12 having a pin aperture 14 extending transversely therethrough. The coupler butt 12 also has a free end 16 which contacts a follower B.

Figure 2:
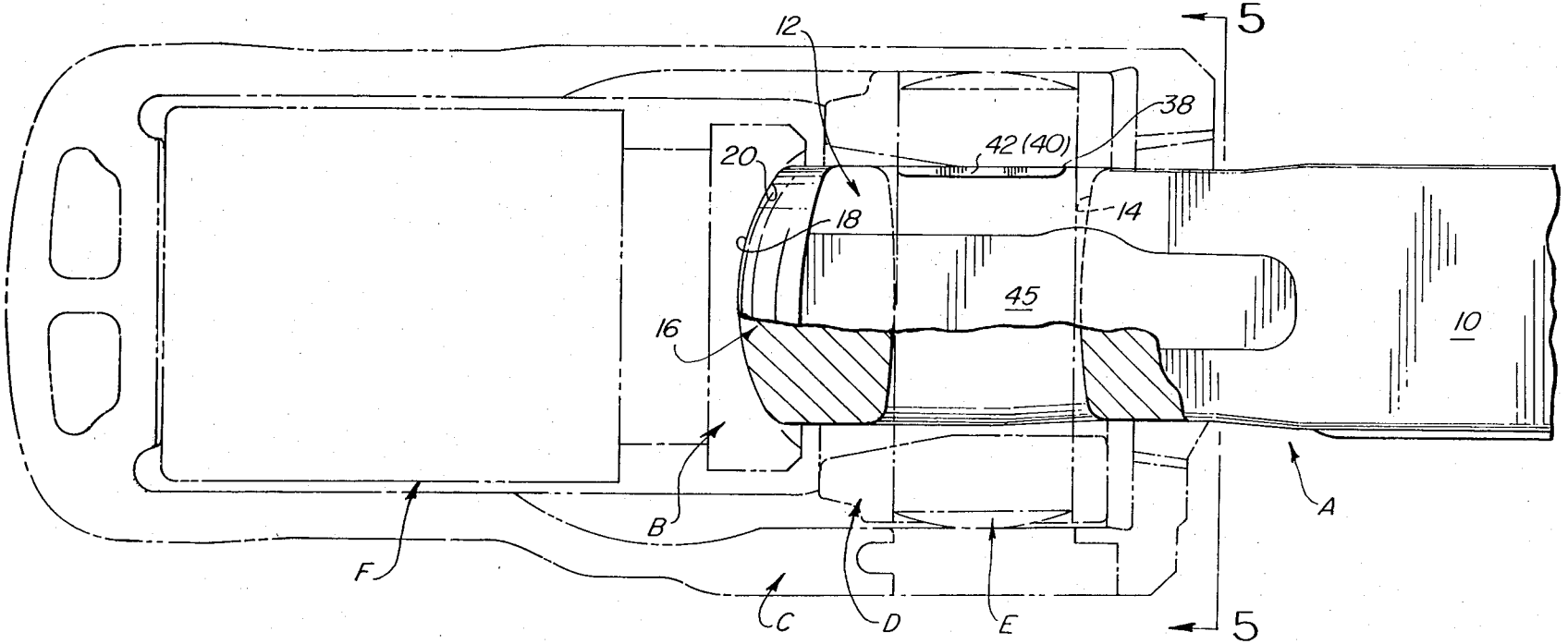
FIG. 2 is a side elevational view in partial cross-section showing the coupler of FIG. 1 as it would normally be positioned in the yoke of a rotary coupling system.

As shown in FIG. 2, the coupler butt portion 12 is positioned in a yoke C with free end 16 thereof contacting the follower B. A generally cylindrical connector D received in the yoke receives, in turn, the coupler butt portion 12, and a pin E extends through both the pin aperture 14 and the connector for connecting these components as is known. A conventional draft gear F urges the follower B toward the coupler butt portion 12.

Figure 3:
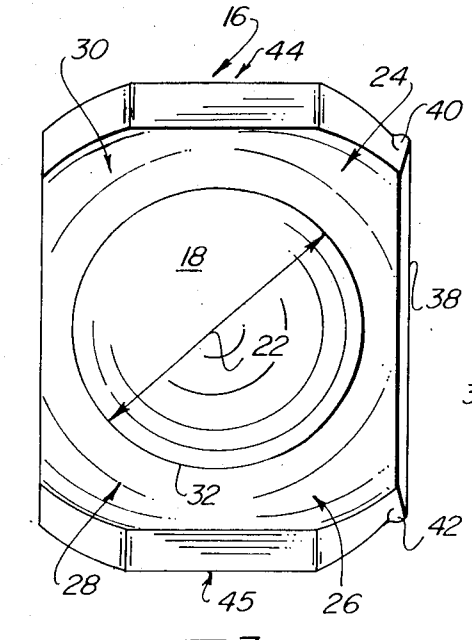
FIG. 3 is a rear elevational view of the coupler of FIG. 1 showing the coupler butt portion.

As can be seen in FIG. 3, the coupler butt free end 16 is essentially rectangular with somewhat tapered corners. The free end is provided with a convex contact face 18 which contacts a concave contact face 20 of the follower. The center 22 of the coupler contact face 18 is relived to prevent fracture of the coupler butt portion 12 along its center.

In order to prevent wear and scoring of the coupler free end 16, the convex contact face 18 is provided with recessed, generally spherical corners as at the areas designated by numerals 24, 26, 28, and 30. Initial contact between the coupler free end 16 and the concave contact face 20 of the follower B occurs at a contact circle 32 on the convex contact face 18. This circle may be approximately four to five inches in diameter, and the spherical area included within this circle has a slightly larger radius as the concave face of follower B. Thus, as the coupler A and follower B approach each other, contact circle 32 defines the first or initial area of positive engagement on the contact face 18, and a smooth transition then occurs toward the inside and the outside of this circle. Assured clearances are provided in butt portion 12 at the center 22 as well as at the four outer edges 24, 26, 28, and 30.

Figure 4:
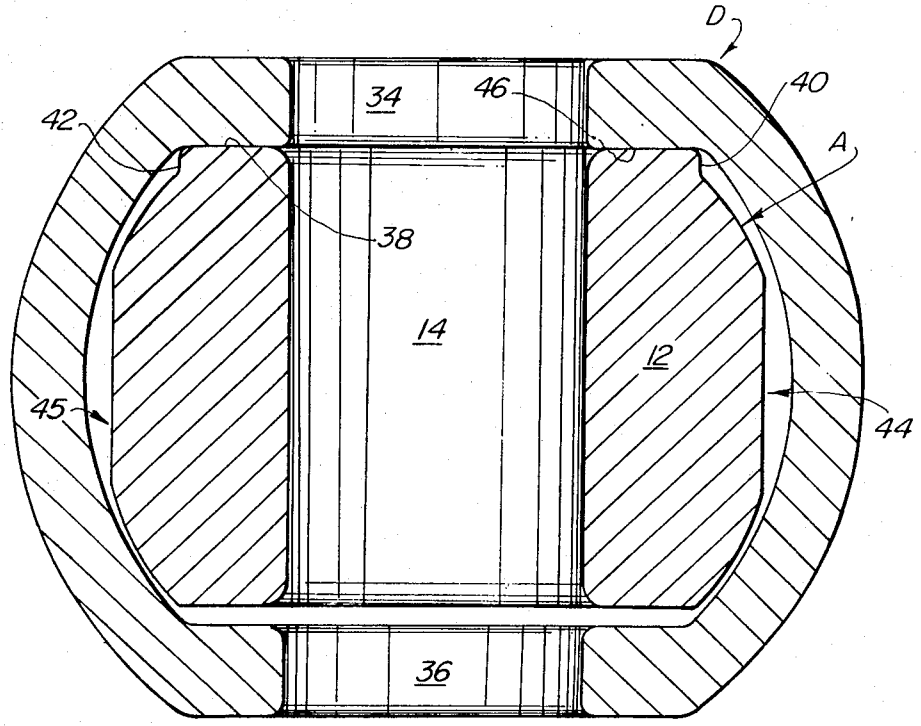
FIG. 4 is a transverse cross-sectional view taken at the coupler mounting aperture and also showing an associated connector member in close surrounding relation therewith; and, FIG. 5 is a cross-sectional view taken along lines 5—5 of FIG. 2.

In FIG. 4, the coupler A is shown in an installed condition closely received by connector D. When so installed, a pin (not shown) extends through the coupler aperture 14 and corresponding apertures 34, 36 in the connector as is conventional. The top or upper surface 38 of the coupler A is provided with first and second relieved portions 40, 42 spaced generally laterally outward from aperture 14. These relieved portions extend generally axially of the coupler butt portion and are located at the intersection of top surface 38 and opposed side walls generally designated 44, 45.

The foregoing relief feature facilitates a specified minimum angling of the coupler butt portion within the connector D, even under worn conditions of the butt portion, and no bearing area between the top of the coupler and the connector is sacrificed with this design. For current unit train service, this minimum angling is commonly 10°, although a greater or lesser amount of angling could also be specified. If the relief feature is not provided, the connector will have a greater tendency to break, or there may even be a derailment of the railway car. That is, without the relief feature, it is more likely that the butt portion 12 will become wedged in the connector and either fracture the connector or cause derailment of the railway car. The relief areas 40, 42 may also be seen in FIGS. 2 and 3.

The foregoing relief feature is provided only at the top area of butt portion 12 since it is this area which will have a tendency to contact the connector at an inside upper surface 46 thereof. This tendency occurs because the coupler butt portion is considerably lighter than the coupler head, and the butt portion thus will rotate upwardly such that top surface 38 contacts the connector surface 46. If the relieved portion is approximately a quarter-inch (¼") in height, the coupler will still perform effectively in the coupler assembly, even after the relief is worn off through frictional use over a period of years.

Figure 5:
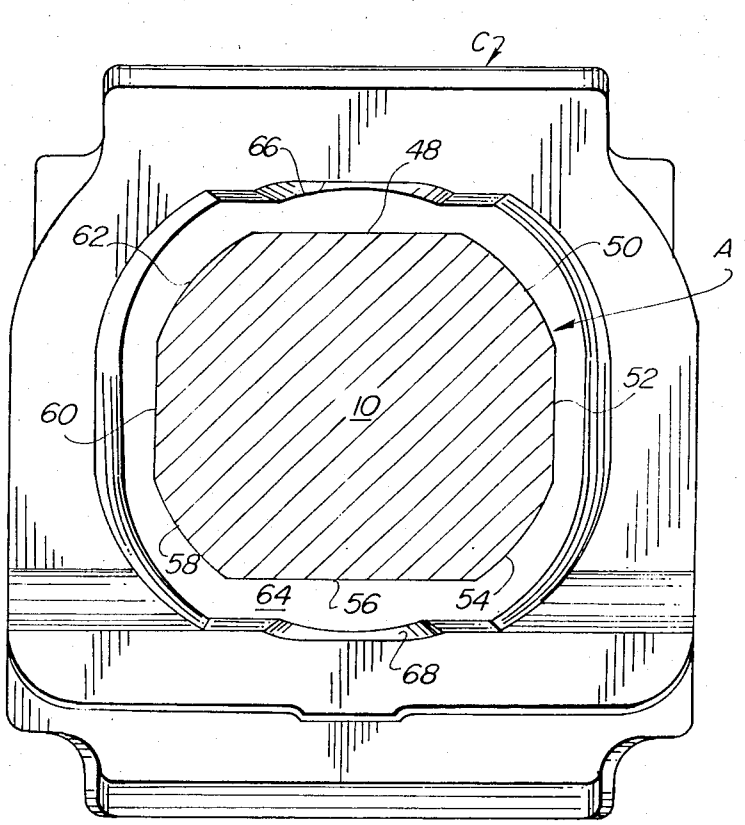

It is evident from the cross-sectional view of FIG. 5 that the coupler shank is generally octagonally shaped. Prior art coupler shanks for rotary coupler assemblies were circular and of considerably smaller diameter than the associated coupler butt portions. The coupler shank of the present invention, however, has been strengthened through use of the octagonal shape. In this connection, the eight surfaces 48, 50, 52, 54, 56, 58, 60, and 62 effectively increase the cross-sectional area of the shank to enable the coupler to bear stresses more equivalent to prior art non-rotary coupler shanks which have substantially square or rectangular cross-sections.

The coupler shank 10 must be necked down somewhat from the size of the coupler butt portion 12 for enabling associated rail cars to angle with respect to each other while travelling around and over curves. However, with the subject strengthened design for coupler shank 10, the railway car is still able to make the necessary turns since the shank has the same envelope of turn in the yoke front end as do prior designs. Moreover, when the coupler A rotates 180° in the yoke C for car unloading purposes, the strengthened coupler shank 10 also can still rotate in the yoke. This is achieved by providing yoke front opening 64 with a pair of upper and lower recesses 66, 68 as is more thoroughly discussed in the co-pending application captioned IMPROVED YOKE FOR RAILWAY CAR COUPLER ASSEMBLY of Richard M. Hanula filed simultaneous herewith.

Among the advantages afforded by the present invention is the provision of a coupler free end which is provided with a contact area as well as relieved corner portions to reduce coupler butt portion wear. Also, relieved portions are provided at the intersections of the coupler butt portion top wall with the side walls in a generally lateral spaced relationship to a pin receiving aperture for allowing limited coupler angling within a connector of the coupling assembly. Moreover, the coupler shank portion has been strengthened while still providing sufficient lateral coupler angling in the yoke as is required for rotary coupling systems.

Although the invention has been shown and described with reference to the preferred embodiment, modifications and alterations will occur to others upon a reading and understanding of this specification. It is intended to include all such modifications and alterations insofar as they come within the scope of the appended claims or the equivalents thereof.

Having thus described the invention, it is now claimed:

1. A coupling assembly for railway cars and the like, said assembly comprising:

a coupler body including a generally rectangular butt portion having a narrower shank portion extending therefrom; said butt portion being provided at a free end thereof opposite said shank portion with a convex surface and wherein said butt portion comprises recessed spherical corners radially outward from said convex surface; and, a follower member having a concave surface therein for receiving said convex surface, said recessed corners being configured and dimensioned to be placed in a non-contacting relationship with said concave surface for reducing wear and scoring on said butt portion free end; said convex surface having a center spherical area thereof having a radius of curvature greater than the radius of curvature of the contact face of said concave surface so that a clearance is provided between the face of said concave surface and the face of said convex surface, whereby the spherical area of said convex surface defines the initial area of positive engagement with said concave surface.

2. The coupling assembly of claim 1 further including a yoke having a transverse front aperture in which said coupler shank portion is housed and wherein said coupler shank portion has an octagonal cross-section for increased strength while maintaining a predetermined minimum turn envelope in said yoke.

3. The coupling assembly of claim 2 further including a connector received in said yoke with said coupler extending into an axial passage in said connector, said coupler butt end portion having a pin receiving aperture extending transversely therethrough disposed in alignment with a pair of spaced pin openings in said connector, said coupler butt portion further including relieved portions adjacent said pin receiving aperture for allowing limited angling of said coupler within said connector and preventing wedging of the said coupler in said connector.

4. The coupling assembly of claim 3 wherein said butt portion includes opposed top and bottom surfaces and opposed side surfaces, said relieved portions being provided in said top surface generally at said side surfaces to extend generally axially of said butt portion in generally lateral spaced relation to said pin receiving aperture.

5. A coupler for a railway car coupling system including a yoke and a follower, said coupler comprising:

a coupler body including a generally rectangular butt portion having a shank portion extending outwardly from one end thereof, said butt portion having a top surface and a bottom surface, and a pair of opposed side surfaces interconnecting said top and bottom surfaces, and a pin receiving aperture communicating between said top and bottom surfaces thereof, said coupler body further including relieved portions in said top surface adjacent said pin receiving aperture for allowing limited angling and preventing wedging of said coupler in an associated coupling assembly, said relieved portions extend generally axially of said butt portion generally at the intersection of said top surface with said pair of side surfaces in generally lateral spaced relation to said pin receiving aperture such that said relieved portions face away from said pin receiving aperture.

* * * * *